US005996463A

United States Patent [19]

Gyre et al.

[11] Patent Number: 5,996,463

[45] Date of Patent: Dec. 7, 1999

[54] SYSTEM FOR ADJUSTING IN ELEVATION AND AZIMUTH A SUPPORT FOR A WEAPON MOUNTED ON A CARRIER

[75] Inventors: Christian Gyre, Chameyrat; Miguele Fabiani; Maurice Capy, both of Tulle, all of France

[73] Assignee: Giat Industries, France

[21] Appl. No.: 09/045,111

[22] Filed: Mar. 20, 1998

[30] Foreign Application Priority Data

Apr. 3, 1997 [FR] France ..... 97.04052

[51] Int. Cl.[6] ..... F41A 27/06

[52] U.S. Cl. ..... 89/37.16

[58] Field of Search ..... 89/37.16, 37.19, 89/37.18, 37.22, 1.54, 1.53

[56] References Cited

U.S. PATENT DOCUMENTS

| | | | |
|---|---|---|---|
| 2,335,835 | 11/1943 | Zietlow, Jr. | 89/37.19 |
| 2,383,985 | 9/1945 | Ogg | 89/37.16 |
| 2,409,618 | 10/1946 | Evans | 89/37.16 |
| 4,223,591 | 9/1980 | Croissant, Jr. | 89/1.53 |
| 4,587,881 | 5/1986 | Clayson et al. | 89/37.16 |
| 5,406,876 | 4/1995 | Harless et al. | 89/1.54 |

FOREIGN PATENT DOCUMENTS

| | | | |
|---|---|---|---|
| 2704050 | 10/1994 | France . | |
| 8506017 | 8/1985 | Germany . | |
| 521205 | 5/1940 | United Kingdom | 89/37.19 |

OTHER PUBLICATIONS

Douglas Aircraft Company, Douglas DGP–1 Twin. So Cal. Gun Package, Mar. 6, 1944, pp. 1–28, 89/37.19.

*Primary Examiner*—Stephen M. Johnson
*Attorney, Agent, or Firm*—Parkhurst & Wendel, L.L.P.

[57] ABSTRACT

An elevation and traverse control system for a weapon support mounted on a carrier strut, comprising elevation control means (S) and traverse control means (G) for the weapon support with respect to a carrier reference, wherein said means (S, G) are fully integrated into the weapon support said weapon support is fastened to the carrier strut by two hooking elements, and said traverse control means (G) are split into two similar devices (G1, G2) which incorporate the two hooking elements.

7 Claims, 5 Drawing Sheets

SYSTEM FOR ADJUSTING IN ELEVATION AND AZIMUTH A SUPPORT FOR A WEAPON MOUNTED ON A CARRIER

BACKGROUND OF THE INVENTION

The present invention relates to an elevation and traverse control system for a weapon support mounted on a carrier, such system comprising elevation control means and traverse control means for the weapon support with respect to a carrier reference.

A fire arm on-board a carrier such as an aircraft, for example, is mounted on a weapon support which can be fastened under a carrier strut of the aircraft. In this case, the elevation and traverse positions of this support must be known and be able to be controlled with respect to a firing system reference, such as a firing sight, for example.

The aim of the invention is to design an elevation and traverse control system which is easy to implement and to control

SUMMARY OF THE INVENTION

To reach this aim, the invention proposes an elevation and traverse control system for a weapon support mounted on a carrier, comprising elevation control means and traverse control means for the weapon support with respect to a carrier reference, wherein said elevation and traverse control means are fully integrated into the weapon support.

According to one characteristic of the system according to the invention, the weapon support is fastened to a strut of the carrier by two hooking elements, and the traverse control means are split into two similar devices which incorporate respectively the two hooking elements of the weapon support on the carrier strut.

Each traverse control device is formed by an off-centre device which comprises, according to one embodiment of the invention, a ring mounted free to rotate with respect to the weapon support but fixed in translation, and the two hooking elements of the weapon support are respectively screwed into these two rings along off-centre axes with respect to those of the rings Thus, by driving one ring of one of the off-centre devices in rotation, it is possible to make the weapon support swivel with respect to the other off-centre device, and vice-versa In practical terms, the traverse control of the weapon support will be carried out by the simultaneous rotation of the two rings of the two off-centre devices in two opposite directions in order to make the weapon support swivel with respect to a point located between the two off-centre devices, thereby increasing the possibilities of control.

According to another characteristic of the invention, the elevation control means are formed by two similar devices which frame the two afore-mentioned off-centre devices, each elevation control device notably comprising two runner plates, mobile in translation along an axis perpendicular to the axis defined by the two off-centre devices of the traverse control means.

According to one embodiment, the two runner plates are mounted opposite one another, guided in translation by slides fastened to the weapon support and intersected from one side to the other by a threaded rod having two inverted threadings such that, according to the direction of rotation given to the threaded rod, the two runner plates can come closer together or move further apart.

The two runner plates of each elevation control device form counter-plates which respectively bear on the fixed plates supported by the carrier strut.

According to one important advantage of the invention, the operations firstly to fasten the weapon support onto the carrier strut, and secondly the operations to control this support, in elevation and in traverse, with respect to a carrier reference, are absolutely dissociated from one another.

According to another important advantage of the invention, the elevation and traverse control operations are easy to carry out, and the control means are easy to use.

Generally speaking, the system according to the invention has been designed more particularly to ensure small adjustments of around ±1° for both traverse and elevation, but which prove in practice to be quite enough.

BRIEF DESCRIPTION OF THE DRAWINGS

Other advantages, characteristics and details of the invention will become apparent from the additional description which follows made with reference to the appended drawings, given merely by way of example and in which.

DESCRIPTION OF THE PREFERRED EMBODIMENTS

Figure 1:
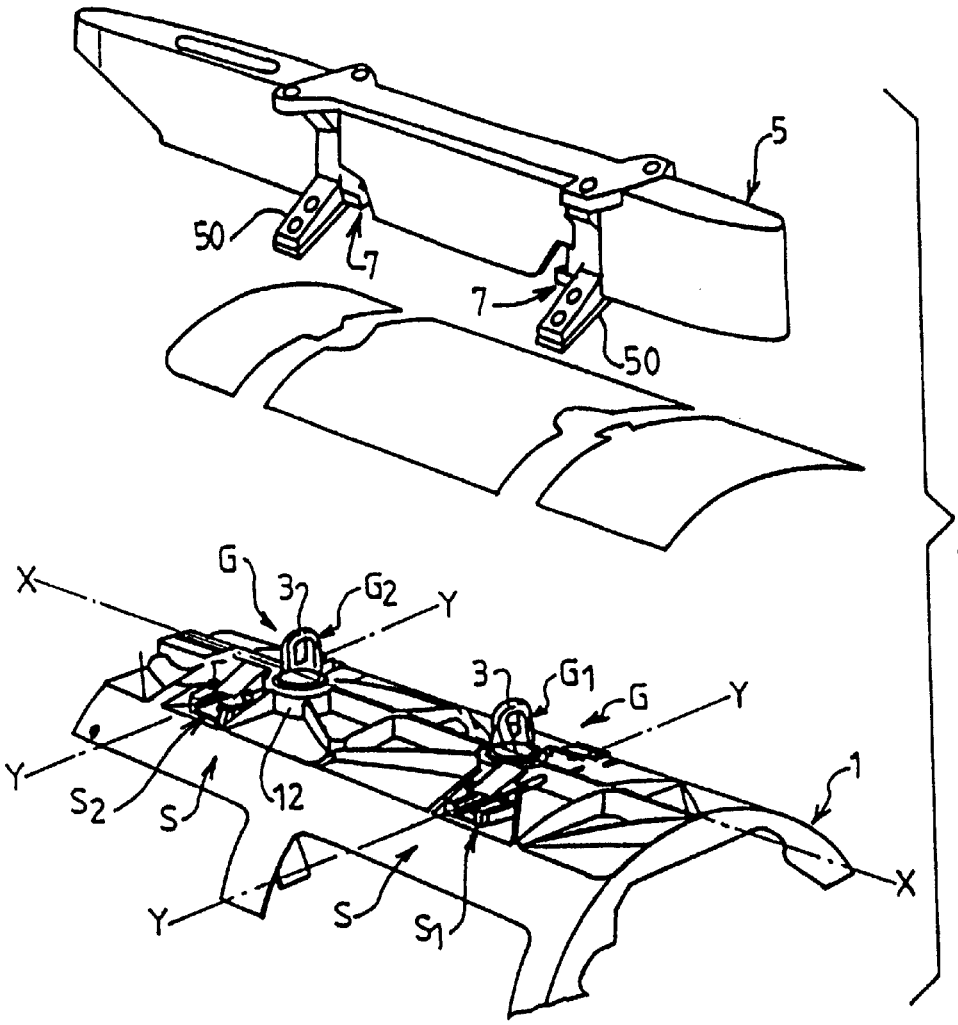
FIG. 1 is an exploded perspective view of an embodiment of the elevation and traverse control system according to the invention of a weapon support mounted on a carrier.

Weapon support 1 shown in FIG. 1 is fastened by two hooking rings 3 under the strut 5 of a carrier (not shown).

Weapon support 1 is fastened using two fingers 7 which pass through rings 3. These fingers 7 are fitted with or cooperate with means not shown whose function is to produce a permanent traction torque which pulls rings 3 towards carrier strut 5.

Once weapon support 1 has been fastened under strut 5, a system enables support 1 to be controlled in elevation and in traverse with respect to a reference of the carrier, such reference can be a firing sight of the firing system.

The elevation and traverse control system is fully integrated into weapon support 1, and it comprises traverse control means G and elevation control means S, which will be described hereafter.

Transverse control means G are formed by two similar off-centre devices G1 and G2, mounted at a distance from one another along axis X—X.

Figure 2:
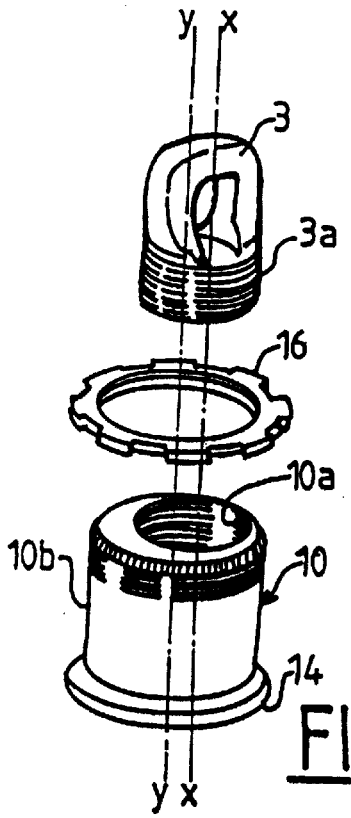
FIG. 2 is an exploded perspective view of part of the traverse control means of the weapon support.

According to the embodiment illustrated in FIG. 2, each off-centre device G1 and G2 notably comprises a ring whose axis x—x of its internal cylindrical wall 10*a* is off-centre with respect to axis y—y of its external cylindrical wall 10*b*.

Figure 5:
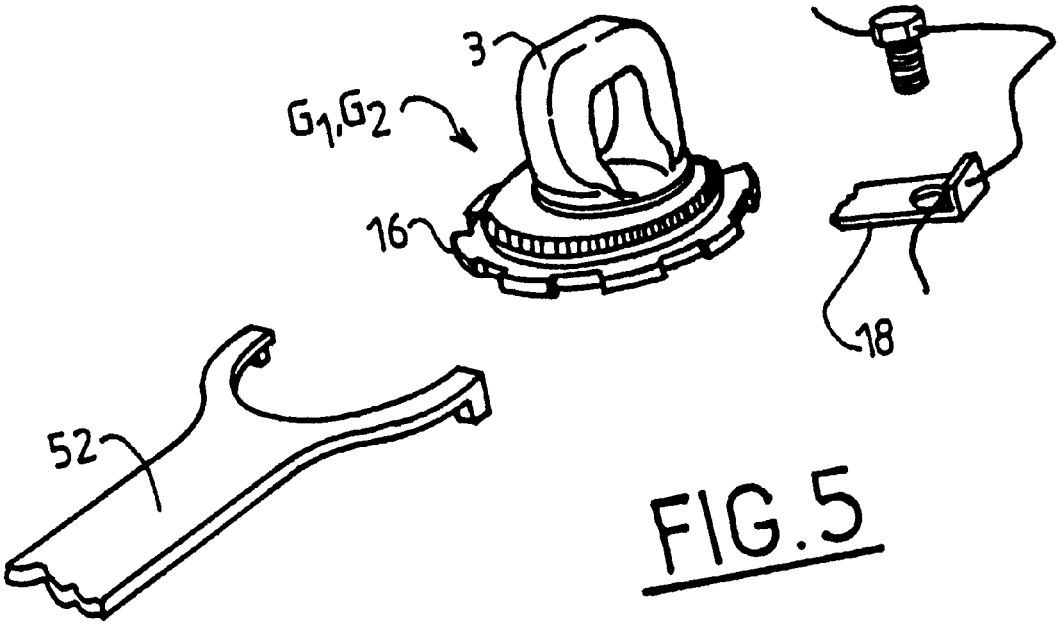

Each ring 10 passes right through a shaft 12 (FIG. 1) arranged in weapon support 1 and inside which ring 10 is mounted free to rotate. On the other hand, each ring 10 is fixed in translation by means of a collar 14 provided at one end of each ring 10 and a castle nut 16 screwed onto an external threading machined towards the other end of each ring 10 (FIG. 2). Once rings 10 have been immobilized in translation, their respective nuts 16 are made integral with rings 10 by means known in themselves and not shown, such means can be a radial pin engaged both in the nut and the ring. Lastly, a removable plate 18 (FIG. 5) is provided to immobilize each nut 16 in rotation and thus each ring 10 when there are no adjustments to be made.

The two off-centre devices G1 and G2 are respectively associated with the two hooking rings 3 of the weapon support. More specifically, each ring 3 is extended by a threaded rod 3*a* intended to be screwed in a matching tapping machined in the internal wall 10*a* of its associated ring 10 (FIG. 2), Thus, the two hooking rings 3 of the weapon support form an integral part of the transverse control means of weapon support 1.

Elevation control means S are formed by two similar devices S1 and S2, respectively mounted in the vicinity of the two off-centre devices G1 and G2. More specifically, the two devices S1 and S2 frame the two device G1 and G2, that is, they are not located between G1 and G2.

Each device S1 and S2 (FIG. 3) notably comprises two runner plates 20 able to translate along axis Y—Y perpendicular to axis X—X defined by the two off-centre devices G1 and G2.

The two runner plates 20 are mounted opposite one another and are intersected from one side to the other by a threaded rod 22 having two inverted threadings 22*a* and 22*b* so that, according to the direction of rotation given to rod 22, the two runner plates 20 can come closer together or move further apart.

Each plate 20 comprises a sole plate 24 through which rod 22 passes and an inclined bearing surface 25. Sole plate 24 of each runner plate 20 is guided in a slide 27 fastened to weapon support 1 by means of screws 29.

In the illustrated example, each slide 27 comprises a base 31 having a U-shaped cross section with a bottom 33 and two wings 35 marking out a guiding groove 37. A plate 39 is fastened to the free end surface of each wing 35 so that one of the sides of plate 39 protrudes into guiding groove 37 thereby forming a rib 40. Sole 24 of each runner plate 20 incorporates two channels 42 in which the two ribs 40 are respectively housed. Screws 45 are used to fastened plates 39 onto soles 31 of slide 27.

After each elevation adjustment to weapon support 1, the assembly formed by runner plates 20 and threaded rod 22 is immobilized in translation. To this end, screws 45 are used which fasten plates 39 onto bases 31 of slides 27 to create friction between ribs 40 of plates 39 and channels 42 of plates 20. To do this, screws 45 merely have to be screwed fully home. Naturally, any other device to immobilized runner plates 20 can be used.

Generally speaking, carrier strut 5 also supports two assemblies of two fixed runner plates 50 which, when weapon support 1 is fastened, respectively bear on the two assemblies formed of the two plates 20 of elevation control means S.

Weapon support 1 is fastened under carrier strut 5 by means of the two hooking rings 3 which have previously been screwed into the two rings 10 of transverse control means G, knowing that this operation is carried out regardless of the elevation and traverse control system of weapon support 1.

Before adjusting the traverse position of weapon support 1 with respect to carrier strut 5, the following preliminary operations are firstly carried out:

removable plates 18, which immobilize the two rings 10 of off-centre devices G1 and G2, are released, and screws 45, which immobilize runner plates 20 of elevation control means S in rotation, are loosened.

Generally speaking, traverse control consists in carrying out a combined and inverted rotation of the two rings 10 of the two off-centre devices G1 and G2 in order to cause weapon support 1 to swivel around a point P located along axis X—X and half-way from the two off-centre devices G1 and G2.

Figure 4:
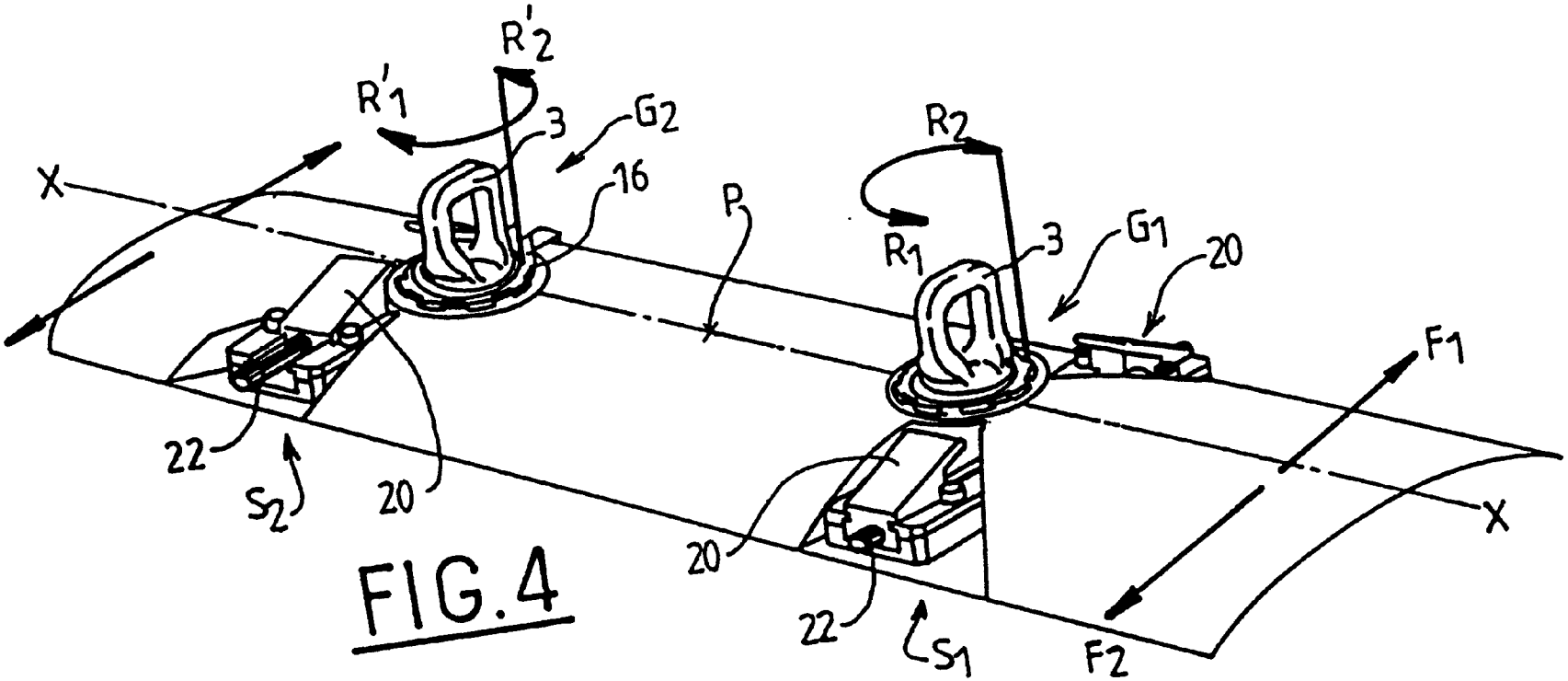
FIGS. 4 and 5 are perspective views to illustrate the traverse control principle of the weapon support.

More specifically, the two rings 10 are driven in rotation by a key 52 (FIG. 5) which engages in two opposite crenels of nut 16 associated with each ring 10. Thus, by driving the two rings 10 in rotation in two opposite rotational directions indicated by arrows R1 and R'1 (FIG. 4), weapon support 1 will swivel around point P in the direction indicated by arrow F1 or, inversely, following arrow F2 for the two rotational directions R2 and R'2 of rings 10.

During the swivelling movement of weapon support 1 with respect to carrier strut 5, each assembly formed by plates 20 and threaded rod 22 of each elevation control device S1 and S2 can move in translation with respect to slides 27, since screws 45 have previously been loosened, such that plates 20 always remain in contact with fixed plates 50 of carrier strut 5.

Once the traverse adjustment of weapon support 1 has been carried out, plates 18 are once again fixed to immobilize in rotation rings 10 of the two off-centre device G1 and G2, and plates 20 of elevation control means S are immobilized in translation by screws 45.

Before adjusting the elevation position of weapon support 1 with respect to carrier strut 5, the only preliminary operation to be carried out is to release in translation plates 20 of elevation control means S. To do this, screws 45 merely have to be loosened.

Figure 3:
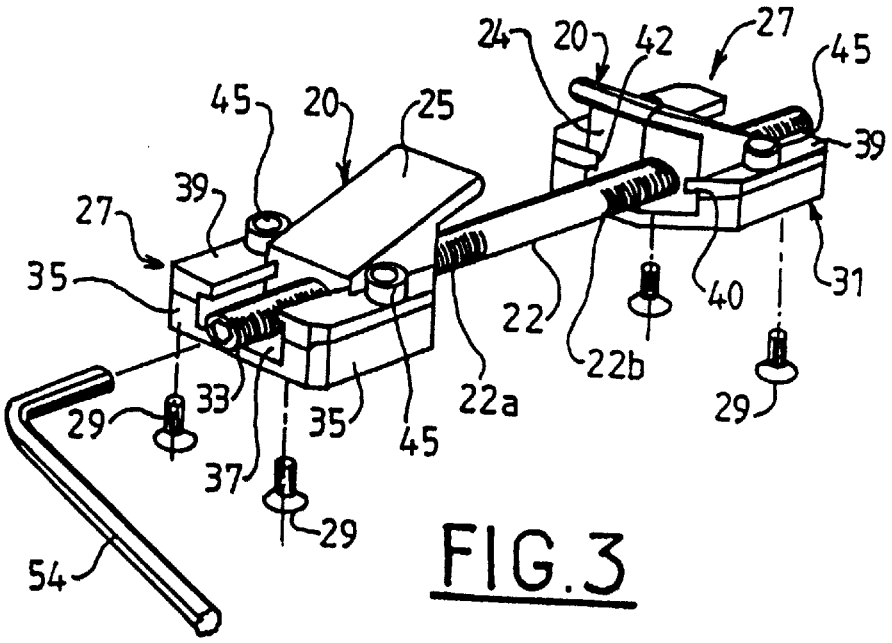
FIG. 3 is a perspective view of the elevation control means of the weapon support.

Elevation movements are obtained by bringing plates 20 of device S1 closer to one another and by moving plates 20 of device S2 further apart, or inversely, by making threaded rods 22 rotate in the appropriate rotational direction by means of a key 54 introduced in the hollow end part of rods 22 (FIG. 3).

Figure 6:
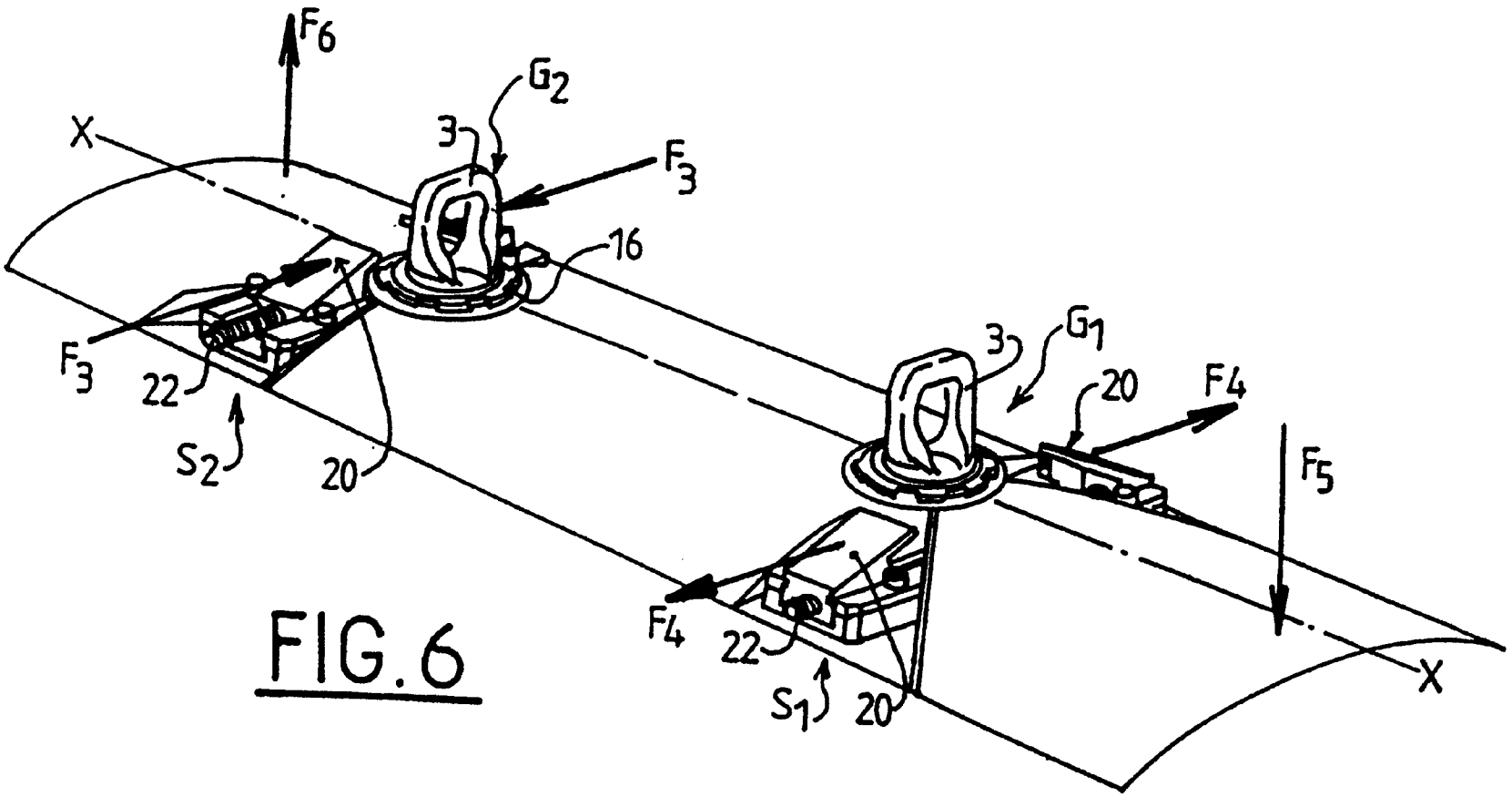
FIG. 6 is a perspective view to illustrate the elevation control principle of the weapon support.

More specifically, elevation control device S1 is assumed to be located towards the front of carrier strut 5 (FIG. 6). In this case, to lower axis X—X, of weapon support 1, that is, to obtain a negative movement in elevation, threaded rod 22 of rear device S2 is driven in rotation to bring plates 20 closer together according to arrows F3, the effect of which is to create a clearance between these plates 20 and associated plates 50 of carrier strut 5 Thereafter, threaded rod 22 of front device S1 is driven in rotation to move plates 20 apart from one another according to arrows F4 As plates 20 of front device S1 are already in contact with associated fixed plates 50 of carrier strut 5. Plates 20 will slide on plates 50 whilst pushing towards the bottom of front device S1, the effect of which is to make weapon support 1 swivel with respect to rear hooking ring 3 to bring plates 20 of rear device S2 into contact with associated fixed plates 50 of carrier strut 5. In other words, axis X—X is lowered following arrow F5 and raised following arrow F6. During the swivelling movement of weapon support 1, front hooking ring 3, which is permanently pulled upon by finger 7, rises slightly.

To obtain a positive movement in elevation, the above operation merely has to be carried out in the opposite manner to raise axis X—X of weapon support 1.

Once the elevation adjustment has been made, plates 20 are once again immobilized in translation by tightening screws 45.

We claim:

1. An elevation and traverse control system for a weapon support mounted on a carrier strut, comprising: elevation control means (S) and traverse control means (G), wherein said elevation control means and traverse control means (S, G) are fully integrated into the weapon support, said weapon support is fastened to said carrier strut by two hooking elements, and said traverse control means (G) comprises two units (G1, G2) which each incorporate one of said hooking elements, each unit (G1, G2) is formed by an off-center device, wherein said off-center device (G1, G2) comprises a ring mounted free to rotate with respect to the weapon support but fixed in translation, and wherein said hooking elements are respectively fastened into the ring along an off-center axes with respect to the ring.

2. A system according to claim 1, wherein said traverse control of the weapon support is carried out by the rotation of the two rings in opposite directions in order to make the weapon support swivel with respect to a point (P) located between the two rings.

3. A system according to claim 2, wherein the rotation of each said ring is controlled by a tool acting on a castle nut integral in rotation with the ring.

4. A system according to claim 1, wherein said elevation control means (S) are formed by two elevation control devices (S1, S2) which frame the two units (G1, G2), and each elevation control device (S1, S2) comprises two runner plates, being mobile in translation to allow movement of the plates towards or away from each other along a first axis (Y—Y) which is perpendicular to a second axis (X—X) defined by the two units (G1, G2).

5. A system according to claim 4, wherein said two runner plates of each elevation control device (S1, S2) are mounted opposite one another, said runner plates are guided in translation by slides fastened to the weapon support and interconnected by a threaded rod having two inverted threadings such that, according to the direction of rotation given to the threaded rod, the two runner plates can move closer together or move further apart.

6. A system according to claim 5 wherein an assembly formed by the two runner plates and said threaded rod connecting them is mobile in translation during a traverse adjustment operation.

7. A system according to claim 4, wherein said runner plates come into contact respectively with fixed plates integral with the carrier strut.

* * * * *